United States Patent [19]

Caldwell et al.

[11] 3,977,958

[45] Aug. 31, 1976

[54] INSOLUBLE ELECTRODE FOR ELECTROLYSIS

[75] Inventors: Donald Lee Caldwell, Lake Jackson; Raymond John Fuchs, Jr., Richwood, both of Tex.

[73] Assignee: The Dow Chemical Company, Midland, Mich.

[22] Filed: Dec. 12, 1974

[21] Appl. No.: 531,934

Related U.S. Application Data

[63] Continuation-in-part of Ser. No. 425,410, Dec. 17, 1973, abandoned.

[52] U.S. Cl. ..... 204/252; 204/290 F; 204/290 R

[51] Int. Cl.[2] ..... C25B 11/04; C25B 11/10

[58] Field of Search ..... 204/290 F, 252, 290 R

[56] References Cited

UNITED STATES PATENTS

| | | | |
|---|---|---|---|
| 3,632,498 | 1/1972 | Beer | 204/290 F |
| 3,706,644 | 12/1972 | Martinsons | 204/98 |
| 3,711,382 | 1/1973 | Anthony | 204/1 R |
| 3,711,397 | 1/1973 | Martinsons | 204/290 F |
| 3,839,181 | 10/1974 | Degueldre et al. | 204/290 F |

*Primary Examiner*—F.C. Edmundson
*Attorney, Agent, or Firm*—Walter J. Lee

[57] ABSTRACT

Electrodes are prepared by coating electrically conductive substrates with an electrically conductive film comprising a single-metal spinel of the formula $Co_3O_4$. The coating can include modifier oxides selected from Groups III-B through VII-B, Groups III-A through V-A, and the Lanthanides and Actinides. Particularly suitable as modifier oxides are the oxides of zirconium, vanadium, titanium, lead, tantalum, tungsten, niobium, cerium, or molybdenum.

These electrodes are particularly suitable for, but not limited to, use as the anode in an electrolytic chlorine cell wherein a diaphragm is interposed between an anode and a cathode in an aqueous electrolyte solution containing sodium chloride.

16 Claims, No Drawings

INSOLUBLE ELECTRODE FOR ELECTROLYSIS

CROSS REFERENCE TO RELATED MATERIAL

This application is a continuation-in-part of application Ser. No. 425,410 filed Dec. 17, 1973 now abandoned.

BACKGROUND OF THE INVENTION

This invention relates to electrodes for use in electrolytic processes such as chlorate cells, chlor-alkali cells, mercury cells, diaphragm cells, or electrocatalytic cells, especially for use as anodes in electrolytic chlorine diaphragm cells.

The rising costs of electrical energy have created a need for more efficient electrodes in various electrolytic processes. One of the most notable of these is the need to replace graphite anodes in electrolytic chlorine cells with anodes which will lower the costs of the electrical energy, even though the graphite may be intrinsically less expensive than the material which replaces it. The deficiencies of, and problems associated with, graphite anodes are well known to practitioners of the art of electrolytic chlorine cells.

DISCUSSION OF PRIOR ART

There are many materials which have the electrical conductivity required of an electrode. The difficulty in the art has been in finding an economically feasible electroconductive material which will resist chemical and/or electrochemical attack over extended periods of time without appreciable loss of its conductivity or of its dimensions.

There are electroconductive materials which retain their high conductivity quite well, but which are eroded away by chemical or electrochemicl attack, e.g., graphite.

There are electroconductive materials which resist chemical or electrochemical attack by forming a protective oxide layer, but the protective oxide coating also reduces the ability of the electrode to provide efficient flow of current. The metals which form the protective oxide layer are called film-formers; titanium is a notable example of these film-formers.

There are expensive noble metals (e.g., platinum) which work well as electrodes, but which are not economically feasible for large scale use. Various attempts have been made to deposit coatings of these expensive noble metals onto less expensive substrates in order to provide electrodes with surfaces that are suitable dimensionally and electrically; that is, they withstand the chemical or electrochemical attack, yet do not suffer losses of conductivity.

Various attempts have been made to provide anodes for electrolytic chlorine cells which are long-lived and are more efficient than graphite in regards to consumption of electric power. Electrodes prepared of, e.g., titanium, tantalum, or tungsten have been coated with various metals and mixtures of metals of the group known as the platinum group metals. These platinum group metals have been deposited on the various conductive substrates as metals and as oxides. Representative patents which teach the use of the platinum group metals as oxides are, e.g., U.S. Pat. Nos. 3,632,498; 3,711,385; and 3,687,724. German Pat. No. 2,126,840 teaches an electrode comprising an electroconductive substrate having an electrocatalytic surface of a bimetal spinel which requires a binding agent. The required binding agent is defined as a platinum group metal or compound and the bimetallic spinel is defined as an oxycompound of two or more metals having a unique crystal structure and formula. The patent teaches that the bimetal spinel is not effective in the absence of the platinum binder.

U.S. Pat. No. 3,399,966 teaches an electrode coated with $CoO_m \cdot nH_2O$, where $m$ is 1.4 to 1.7 and $n$ is 0.1 to 1.0. South African Pat. No. 71/8558 teaches the use of cobalt-titanate as a coating for electrodes.

U.S. Pat. No. 3,632,498 teaches an electrode comprising a conductive, chemically resistant base coated with at least one oxide of a film-forming metal and at least one oxide of a platinum group metal.

Other patents which disclose various spinel or other metal oxide coatings on electroconductive substrates are, e.g., U.S. Pat. Nos. 3,711,397; 3,706,644; 3,689,382; 3,672,973; 3,711,382 3,773,555; 3,103,484; 3,775,284; 3,773,554; and 3,663,280.

There is a need for electrode coating materials which are inexpensive, readily available, resist chemical or electrochemical attack, and which do not suffer significant losses of conductivity over extended periods of operation. This need is met by the present invention wherein an electroconductive substrate is coated with an effective amount of a single-metal spinel of $Co_3O_4$. An "effective amount" of the coating on the substrate means: (1) in the case where film-forming substrates are used, an "effective amount" is that amount which will provide sufficient current flow between the electrolyte and the substrate; and (2) in the case where the substrate is not a film-former, an "effective amount" is enough not only to provide sufficient current flow between the electrolyte and the substrate but also to substantially protect the substrate from chemical or electrochemical attack.

The present invention provides a highly efficient electrode which does not require expensive metals of the platinum group; this provides an economic advantage.

SUMMARY OF THE INVENTION

It has now been unexpectedly found that highly efficient, insoluble electrodes are prepared by depositing on a suitable electro-conductive substrate a coating of a single-metal spinel $Co_3O_4$. Preferably, the electroconductive substrate is one of the film-forming metals which are found to form a thin protective oxide layer when subjected directly and anodically to the oxidizing environment of an electrolytic cell. Electroconductive substrates which are not film-forming metals are also operable, but generally are not preferred due to the possibility of chemical attack of the substrate if it contacts the electrolyte or corrosive substances.

Furthermore, it has been found to be advantageous to co-deposit a "modifier oxide" along with the single-metal spinel. The "modifier oxides" may be, preferably, one or more of the oxides of, e.g., titanium, tantalum, tungsten, zirconium, vanadium, lead, niobium, cerium, or molybdenum.

DETAILED DESCRIPTION OF PREFERRED EMBODIMENTS

Preferably, the electroconductive substrate is one of the film-forming metals selected from the group consisting of titanium, tantalum, tungsten, zirconium, molybdenum, niobium, hafnium, and vanadium. Most preferably the electroconductive substrate is titanium, tantalum, or tungsten. Titanium is especially preferred.

Alloys of the above named film-forming metals may also be used, such as titanium containing a small amount of palladium or aluminum and/or vanadium. A Beta III alloy containing Ti, Sn, Zr, Mo is operable. Many other possible alloys will be apparent to persons skilled in the art.

The function of the substrate is to support the electroconductive film of single-metal spinel and to conduct electrical current which is conducted by and through the spinel coating. Thus, it can be seen that there are a large number of possibilities for selection of the substrate. The film-forming substrates are desirable for use in the present invention in those instances in which the single-metal-spinel coated electrode is used as an anode in an electrolytic diaphragm chlorine cell. The ability of the electrically conductive film-forming substrate to form a chemically-resistant protective oxide layer in the chlorine cell environment is important in the event a portion of the substrate becomes exposed to the environment in the cell.

The "modifier oxide" is selected from among the following listed groups:

Group III-B (Scandium, Yttrium)
Group IV-B (Titanium, Zirconium, Hafnium)
Group V-B (Vanadium, Niobium, Tantalum)
Group VI-B (Chromium, Molybdenum, Tungsten)
Group VII-B (Manganese, Technetium, Rhenium)
Lanthanides (Lanthanum through Lutetium)
Actinides (Actinium through Uranium)
Group III-A Metals (Aluminum, Gallium, Indium, Thallium)
Group IV-A Metals (Germanium, Tin, Lead)
Group V-A Metals (Antimony, Bismuth).

The "modifier oxide" is, preferably, an oxide of cerium, bismuth, lead, vanadium, zirconium, tantalum, niobium, molybdenum, indium, chromium, tin, aluminum, antimony, titanium, or tungsten. Mixtures of modifier oxides may also be used.

Most preferably, the "modifier oxide" is selected from the group consisting of zirconium, vanadium, and lead, or mixtures of these, with zirconium being the most preferable of these.

The amount of "modifier oxide" metal or metals may be in the range of zero to about 50 mole %, most preferably about 5 to about 20 mole % of the total metal of the coating deposited on the electroconductive substrate. Percentages, as expressed, represent mole percent of metal, as metal, in the total metal content of the coating.

The $Co_3O_4$ coatings of the present invention (with or without the modifier oxides) are conveniently prepared by repeated applications of metal-organic compounds, each application (or layer) being thermally decomposed to yield the metal oxide. The coating step is repeated as necessary until the desired thickness (preferably about 0.01 to about 0.08 mm) is reached.

The examples which follow hereinafter demonstrate forming of the oxide coatings by thermally decomposing appropriate metal-organic compounds.

The formation of the single-metal spinel crystalline structure was shown by X-ray diffraction. This technique for establishing the existence of single-metal spinels is commonly used and details of this technique are found in, e.g., *X-Ray Diffraction Procedures* by H. P. Klug and L. E. Alexander, John Wiley & Sons, N.Y.C. (1954).

A preferred method of preparing the single-metal spinel coatings of the present invention is as follows:

1. Prepare the substrate by chemically or abrasively removing oxides and/or surface contaminants.
2. Coat the substrate with the desired thermally-decomposable metal compound (e.g. one or more metal salts of fatty acids) and
3. heat the coated substrate to a temperature high enough, and for a time sufficient, to decompose the coating and yield the metal oxide-coated substrate. For most compounds, e.g. the metal salts of fatty acids, temperatures in the range of 200°–600°C and baking times of about 5–60 minutes are generally sufficient.

When high baking temperatures are employed, the baking time is held to short periods of time in order to obtain the best results. When low baking temperatures are employed, longer baking times are used to assure essentially complete conversion of the metal-organic compounds to metal oxides. If temperatures as high as 600°C are used, baking time should be held to only a few minutes, say about 5 minutes. When temperature is as low as 200°C, baking times of as much as 60 minutes may be used.

It is not desired that the invention be limited by the following theoretical explanation and it is offered only as a plausible explanation of the interaction between heating time and heating temperature which is observed in the practice of the invention. It is believed that holding the coated substrate at a given temperature for unnecessarily long periods of time can allow oxygen migration to penetrate the coating and reach the substrate, thereby reducing the effectiveness of the coated substrate as an anode. It is also believed that increased periods of heating time, such as received by each coating at the time subsequent coatings are made, cause densification or loss of porosity in the coating, thereby improving the impermeability to oxygen. Thus, it is preferred to employ only enough heating time for the first coat (or first few coats) to substantially form the $Co_3O_4$. For this first coat, it is preferred that a maximum temperature of about 450°–500°C be employed with a maximum heating time of about 15–20 minutes. As more coatings are added, the undercoatings appear to densify and higher temperature or longer heating time may be employed for subsequent coatings. Ordinarily, at least four coatings of the $Co_3O_4$ are performed, preferably at least six. The final coating is given extra baking time in order that it may undergo densification thereby becoming less permeable to oxygen and also become less likely to slough-off during handling and operation.

The optimum temperature and time of baking can be determined experimentally for a given metal compound or mixtures of compounds. The steps of coating and baking can be repeated as many times as is necessary to achieve the desired coating thickness. Generally, a coating thickness of about 0.01 to about 0.08 mm is desired. As stated hereinbefore, the amount of modifier oxide metal or metals in the single-metal spinel coating can vary from 0 to about 50 mole percent of the total metal in the coating. Above this range of concentration the $Co_3O_4$ coating can no longer be characterized as principally comprising only a structure of crystals of a single-metal spinel. As the mole ratio of spinel metal/modifier metal in the coating approaches 1/1, the crystallinity, as shown by X-ray diffraction, is found to diminish considerably.

As will be easily recognized by skilled artisans, the measurement given for thickness or depth of these types of coatings is, essentially, an average value. It will also be recognized that the thinner the coating is, the greater will be the chance that "pin-holes" or defects in the coating will occur. The best coatings (i.e., having fewest pin-holes and defects) are obtained by applying the coating as a plurality of layers so as to "build-up" to the desired thickness. Coatings less than about 0.01 mm are likely to suffer from defects which will limit their efficiency. Coatings greater than about 0.08 mm are operable, but the greater thickness provides no improvement which is commensurate with the added expense of building-up such thicker coating.

By employing the coating techniques described and referred to above, thin single-metal spinel coatings, with or without modifier oxides contained herein, may be applied to electroconductive substrates of any convenient shape or form, e.g. mesh, plate, sheet, screen, rod, cylinder, or strip.

As used herein, the expressions "film" or "coating", in referring to the single-metal spinel structure, means that a layer of the single-metal spinel structure is deposited onto, and adheres to, the substrate, even though the layer may actually be "built-up" by a plurality of applications of the oxides or oxide-forming material. The single-metal spinel of $Co_3O_4$ is sufficiently adherent to the substrate for most applications; however, the use of the "modifier oxides" generally improves the adherence, hardness, and toughness of the coating.

As used herein, the expression "contained" when referring to the modifier oxide in the spinel structures, means that the modifier oxides are essentially homogenously or evenly distributed through the single-metal spinel structure.

In the following embodiments, the thickness of the coatings applied is estimated to be in the range of about 0.5 mil to about 3 mils (i.e. about 0.01 mm to about 0.08 mm). The reason for estimating rather than directly measuring the thickness is because the best methods for performing the measuring involve destruction of the coating. Thus, it is recommended that the coating technique be studied first on specimens which can be destroyed rather than tested as electrodes. Once it is learned what thickness can be expected by a given coating method, taking into account the number of layers applied, then further coatings can be prepared with the reasonable expectation that substantially the same thickness of coating will again be obtained.

It has been determined that when coatings are applied by a plurality of layer applications as in the following Examples I through XVII each subsequent layer is not the same thickness as the preceding layer. Therefore, a coating built-up of, say, 12 layers is not twice as thick as a coating built-up of six layers.

In most applications in which the electrodes of the present invention are useful, current densities in the range of about 0.2 to 2.0 amps/in$^2$ (0.03 to 0.3 amps/cm$^2$) are most likely to be employed. The following examples employ a current density of 0.5 amps/in$^2$ (0.77 amp/cm$^2$) which is considered to be within the nominal range for the cells used in the examples.

EXAMPLES AND EMBODIMENTS OF THE INVENTION

In the examples which follow, Cell A was a laboratory chlorate cell. This cell comprises a battery jar containing a 300 GPL (grams per liter) NaCl solution at ambient temperature (about 22°–25°C). The cathode was a titanium strip about 6 inches × 0.5 inch (15.24 × 1.27 cm). Anode-cathode spacing was approximately 1 inch (2.54 cm). Electrolysis was conducted at an apparent current density of 0.5 amp/in$^2$ (approx. 0.077 amp/cm$^2$) anode area.

Cell B was a diaphragm chlorine cell. The diaphragm was deposited from an asbestos slurry onto an iron screen cathode in the conventional manner. Anode and cathode were each approximately 3 inches × 3 inches (7.62 cm × 7.62 cm). Current was brought to the electrodes by a brass rod brazed to the cathode and a titanium rod either welded or bolted to the anode. Anode to cathode spacing was ¼ inch (0.635 cm). Temperature of the cell was maintained at 80° ± 3°C. A 300 GPL NaCl solution was fed continuously to the anolyte compartment via a constantoverflow system. Chlorine, hydrogen and sodium hydroxide were withdrawn continuously from the cell. Anolyte and catholyte levels were adjusted to maintain an NaOH concentration in the catholyte of about 100 GPL. Power was supplied to the cell by a constant current power supply. Electrolysis was conducted at an apparent current density of 0.5 amp per square inch (approx. 0.77 amp/cm$^2$) anode area.

In the following examples, the "Cobalt Octoate" (12% Co), "Zirconium NuXtra" (6% Zr) and "Lead Octoate" (24% Pb) are metal salts of fatty acids diluted with mineral spirits; they are sold by Tenneco Chemicals, Inc. The Vanadyl Naphthene (1.1% V) was reagent grade, obtained from Research Organic/Inorganic Chemical Corp. The Tantalum 2-ethyl Hexanoate (18.5% Ta) was synthesized from reagent grade tantalum chloride and 2-ethyl hexanoic acid, purified, and confirmed by analysis. The Niobium 2-ethyl Hexanoate (4.31% Nb) was synthesized from reagent grade niobium chloride and 2-ethyl hexanoic acid, purified, and confirmed by analysis. The Molybdenyl (V) Naphthenate (6.7% Mo) was reagent grade, obtained from Research Organic/Inorganic Chemical Corp.

EXAMPLE I

An ASTM Grade 1 titanium plate 3 inches × 3 inches × 5/64 inch was blasted with $Al_2O_3$ grit to a uniform rough surface, blown clean with air, soaked briefly in dimethyl formamide, and allowed to air dry. A coating mixture was prepared by mixing 121.56 g "Cobalt Octoate" (12% Co) with 34.28g "Zirconium NuXtra" (6% Zr).

The coating mixture was brushed onto the cleaned titanium plate. The plate was baked in a 400°C oven about 15 minutes, removed, and cooled in air about 10 minutes. Eleven more coats were applied in a similar manner. The plate was then allowed to stand overnight in air. Eleven further coats were then applied in a similar manner, and a final coat was applied and baked 60 minutes at 400°C. The anode was placed in a test cell of design "B" and operated continuously as described above. Initial voltage was 3.049V; voltage after 333 days continuous operation was 3.304V.

EXAMPLE II

An ASTM Grade 1 titanium plate 3 inches × 3 inches × 5/64 inch was blasted with $Al_2O_3$ grit to a uniform rough surface, blown clean with air, soaked briefly in dimethyl formamide, and allowed to air dry. A solution of "Cobalt Octoate" (12% Co by weight) was brushed onto the cleaned titanium plate. The plate was baked about 15 minutes in a 400°C oven, removed, and cooled in air about 10 minutes. Sixteen more coats were applied in a similar manner. The anode was then placed in a dessicator overnight. Eighteen more coats were then applied in a similar fashion. A 36th coat was applied and the anode was then baked 62 minutes at 400°C. The anode was placed in a type "B" test cell and operated continuously as described above. Initial voltage was 3.199 volts; voltage after 258 days continuous operation was 3.535 volts.

EXAMPLE III

An ASTM Grade 1 titanium plate 3 inches × 3 inches × 5/64 inch was blasted with $Al_2O_3$ grit to a uniform rough surface, blown clean with air, soaked briefly in dimethyl formamide, and allowed to air dry. A coating mixture was prepared by mixing 200.00 g "Cobalt Octoate" (12% Co) with 37.70 g "Zirconium NuXtra" (6% Zr).

The coating mixture was brushed onto the cleaned titanium plate. The plate was baked 10 minutes in a 450°C oven, removed, and cooled in air 10 minutes. Four coats were applied in a similar manner. A sixth coat was applied and baked 60 minutes at 450°C. The anode was placed in a type "B" test cell and operated continuously as described above. Initial voltage was 3.134 volts; voltage after 370 days continuous operation was 3.748 volts.

EXAMPLE IV

An ASTM Grade 1 titanium plate 3 inches × 3 inches × 5/64 inch was blasted with $Al_2O_3$ grit to a uniform rough suface, blown clean with air, soaked briefly in dimethyl formamide, and allowed to air dry. A coating mixture was prepared by mixing 121.56 g "Cobalt Octoate" (12% Co) with 34.26 g "Zirconium NuXtra" (6% Zr).

The coating mixture was brushed onto the cleaned titanium plate. The plate was baked in a 400°C oven about 30 minutes, removed, and cooled in air about 10 minutes. Twenty-one more coats were applied in a similar manner, and a twenty-fourth coat was applied and baked 60 minutes at 400°C. The anode was placed in a test cell of design "B" and operated continuously as described above. Initial voltage was 3.293V; voltage after 212 days continuous operation was 3.832V.

EXAMPLE V

An ASTM Grade 1 titanium plate 3 inches × 3 inches × 5/64 inch was blasted with $Al_2O_3$ grit to a uniform rough surface and blown clean with air. A coating mixture was prepared by mixing 7.10 g "Cobalt Octoate" (12% Co) with 1.34 g "Zirconium NuXtra" (6% Zr).

The coating mixture was brushed onto the cleaned titanium plate. The plate was baked in a 400°C oven about 21 minutes, removed, and cooled in air about 28 minutes. Two more coats were applied in a similar manner, and a fourth coat was applied and baked 59 minutes at 400°C. The anode was placed in a test cell of design "B" and operated continuously as described above. Initial voltage was 2.945V; voltage after 200 days continuous operation was 3.458V.

EXAMPLE VI

An ASTM Grade 1 titanium plate 3 inches × 3 inches × 5/64 inch was blasted with $Al_2O_3$ grit to a uniform rough surface, blown clean with air, soaked briefly in dimethyl formamide, and allowed to air dry. A coating mixture was prepared by mixing 30.39 g of "Cobalt Octoate" (12% Co) with 8.57 g of "Zirconium NuXtra" (6% Zr).

In this example, the coating mixture was brushed onto the cleaned titanium plate. The plate was baked in a 400°C oven about 15 minutes, removed, and cooled in air about 10 minutes. Three more coats were applied in a similar manner. The plate was then allowed to stand overnight in air. A fifth coat was applied and baked 65 minutes at 400°C. The anode was placed in a test cell of design "B" and operated continuously as described above. Initial voltage was 2.998V; voltage after 180 days continuous operation was 3.477 volts.

EXAMPLE VII

An ASTM Grade 1 titanium plate 3 inches × 3 inches × 5/64 inch was blasted with $Al_2O_3$ grit to a uniform rough surface and blown clean with air. A coating mixture was prepared by mixing 16.95 g "Cobalt Octoate" (12% Co) with 4.28 g "Zirconium NuXtra" (6% Zr).

The coating mixture was brushed onto the cleaned titanium plate. The plate was baked in a 500°C oven about 28 minutes, removed, and cooled in air about 13 minutes. Two more coats were applied in a similar manner, and a fourth coat was applied and baked 70 minutes at 500°C. The anode was placed in a test cell of design "B" and operated continuously as described above. Initial voltage was 3.488V; voltage after 61 days continuous operation was 3.830V.

EXAMPLE VIII

An ASTM Grade 1 titanium plate 3 inches × 3 inches × 5/64 inch was blasted with $Al_2O_3$ grit to a uniform rough surface, blown clean with air, soaked briefly in dimethyl formamide, and allowed to air dry. A coating mixture was prepared by mixing 30.39 g "Cobalt Octoate" (12% Co) with 8.57 g "Zirconium NuXtra" (6% Zr).

The coating mixture was brushed onto the cleaned titanium plate. The plate was baked in a 400°C oven about 15 minutes, removed, and cooled in air 10 minutes. Four more coats were applied in a similar manner, and a sixth coat was applied and baked 910 minutes at 400°C. The anode was placed in a test cell of design "B" and operated continuously as described above. Initial voltage was 3.245V; voltage after 58 days continuous operation was 3.580V.

EXAMPLE IX

An ASTM Grade 1 titanium plate 3 inches × 3 inches × 5/64 inch was blasted with $Al_2O_3$ grit to a uniform rough surface, blown clean with air, soaked briefly in dimethyl formamide, and allowed to air dry. A coating mixture was prepared by mixing 100.00 g "Cobalt Octoate" (12% Co) with 77.50 g "Zirconium NuXtra" (6% Zr).

The coating mixture was brushed onto the cleaned titanium plate. The plate was baked in a 350°C oven 60 minutes, removed, and cooled in air 10 minutes. Five more coats were applied in a similar manner. The anode was placed in a test cell of design "B" and operated continuously as described above. Initial voltage was 2.928V; voltage after 144 days continuous operation was 3.857V.

Table I (Examples I–IX; on Ti plate, using cell "B")

| Example | Preparation of Coated Substrate[1] | | | | | Operating Data (0.5A/in²)[2] | | | |
|---|---|---|---|---|---|---|---|---|---|
| | Approx. mole ratio, Co/Zr | No. Coats | Baking Temp. °C | Baking Time min. | Baking Time of Final Coat, min. | Initial Voltage[3] | Final Voltage | Days of Operation | Δv/t mv./day |
| I | 11.0 | 24 | 400 | 15 | 60 | 3.049 | 3.304 | 333 | 0.8 |
| II | N.A.[4] | 36 | 400 | 15 | 62 | 3.199 | 3.535 | 258 | 1.3 |
| III | 16.4 | 6 | 450 | 10 | 60 | 3.134 | 3.748 | 370 | 1.7 |
| IV | 11.0 | 24 | 400 | 30 | 60 | 3.293 | 3.832 | 212 | 2.5 |
| V | 16.4 | 4 | 400 | 21 | 59 | 2.945 | 3.458 | 200 | 2.6 |
| VI | 11.0 | 5 | 400 | 15 | 65 | 2.998 | 3.477 | 180 | 2.7 |
| VII | 12.2 | 4 | 500 | 28 | 70 | 3.488 | 3.830 | 61 | 5.6 |
| VIII | 11.0 | 6 | 400 | 15 | 910 | 3.245 | 3.580 | 58 | 5.8 |
| IX | 4.0 | 6 | 350 | 60 | 60 | 2.928 | 3.857 | 144 | 6.5 |

[1]Ti plate coated with $Co_3O_4$ with zirconium oxide modifier except for Example II
[2]Operation in "B" type cell
[3]Initial voltage after stabilization period of 2–3 days
[4]N.A. means not applicable, $CO_3O_4$ coating without modifier oxide

EXAMPLE X

Six cylinders of ASTM Grade 2 titanium, each approximately ⅜ inch (9.53 mm) diameter × ¾ inch (19.05 mm) long, were washed in an ultrasonic bath, using commercial laboratory detergent. They were rinsed in deionized water and acetone. They were blasted with $Al_2O_3$ grit to a uniform rough surface and blown clean with air. They were coated with either "Cobalt Octoate" (samples *a*, *b*, *c*) or a mixture of "Cobalt Octoate" and "Zirconium NuXtra" (samples *d*, *e*, and *f*) as shown in Table II below. In each case the baking time for each coat, except the last, was 5 minutes, the cooling time was 10 minutes, and the baking time of the last coat was 60 minutes. Each sample had 6 coats except Sample *e* which had 24 coats. X-Ray diffraction data was obtained using a standard Norelco goniometer equipped with an AMR monochromator on the receiving detector assembly. Unfiltered CuK $\alpha$ radiation was used. $Co_3O_4$ was detected in each sample.

Table II (For Example X)

| Sample | Mole Ratio Co/Zr | Baking Temp. °C | Mean Crystallite Size A° |
|---|---|---|---|
| a | N.A. | 350 | 100 |
| b | N.A. | 400 | 110 |
| c | N.A. | 450 | 125 |
| d | 16.4 | 350 | 100 |
| e | 2.6 | 350 | 50 |
| f | 2.6 | 450 | <50 |

EXAMPLE XI

An ASTM Grade 1 titanium plate 3 inches × 3 inches × 5/64 inch was blasted with $Al_2O_3$ grit to a uniform rough surface, blown clean with air, soaked briefly in dimethyl formamide, and allowed to air dry. A coating mixture was prepared by mixing 100.00 g "Cobalt Octoate" (12% Co) with 25.10 g "Lead Octoate" (24% Pb).

The coating mixture was brushed onto the cleaned titanium plate. The plate was baked about 15 minutes in a 400°C oven, removed, and cooled in air about 10 minutes. Twenty-two more coats were applied in a similar manner. The 24th coat was applied and the anode was then baked 60 minutes at 400°C. The anode was placed in a type "B" test cell and operated continuously as described above. Initial voltage was 3.159 volts; voltage after 61 days continuous operation was 4.093 volts.

EXAMPLE VII

An ASTM Grade 1 titanium plate 3 inches × 3 inches × 5/64 inch was blasted with $Al_2O_3$ grit to a uniform rough surface, blown clean with air, soaked briefly in dimethyl formamide and allowed to air dry. A coating mixture was prepared by mixing 10.00 g "Cobalt Octoate" (12% Co) with 2.08 g Vanadyl Naphthenate (1.1% V).

The coating mixture was brushed onto the cleaned titanium plate. The plate was baked in a 400°C oven 15 minutes, removed, and cooled in air 10 minutes. Four more coats were applied in a similar manner. A sixth coat was applied and baked 60 minutes at 400°C. The anode was placed in a test cell of design "B" and operated continuously as described above. Initial voltage was 3.162 volts; voltage after 42 days continuous operation was 3.779 volts.

EXAMPLE XIII

A piece of expanded titanium mesh 3 inches × 3 inches × 1/16 inch was blasted with $Al_2O_3$ grit to a uniform rough surface, blown clean with air, soaked briefly in dimethyl formamide, and allowed to air dry. A coating mixture was prepared by mixing 121.56 g "Cobalt Octoate" (12% Co) with 34.26 g "Zirconium NuXtra" (6% Zr).

The coating mixture was sprayed onto the cleaned titanium mesh. The mesh was baked in a 400°C oven 15 minutes, removed, and cooled in air 10 minutes. Twenty-two more coats were applied in a similar manner. The 24th coat was applied and the anode was then baked 60 minutes at 400°C. The anode was placed in a type "B" test cell and operated continuously as described above. Initial voltage was 3.186 volts; voltage after 12 days continuous operation was 3.250 volts.

EXAMPLE XIV

A piece of tantalum plate, approximately 3 inches × 3 inches × 3/32 inch (2.38 mm) was blasted with $Al_2O_3$ grit to a uniform rough surface, blown clean with air, soaked briefly in dimethyl formamide, and allowed to air dry. A coating mixture was prepared by mixing 121.56 g "Cobalt Octoate" (12% Co) with 34.26 g "Zirconium NuXtra" (6% Zr).

The coating mixture was brushed onto the cleaned tantalum plate. The plate was baked 15 minutes in a 400°C oven, removed, and cooled in air 10 minutes. Twenty-two more coats were applied in a similar manner. A 24th coat was applied and the anode was then baked 60 minutes at 400°C. The anode was placed in a type "B" test cell and operated continuously as described above. Initial voltage was 4.134 V; voltage after 11 days continuous operation was 4.401V.

EXAMPLE XV

An ASTM Grade 1 titanium plate (approx. 6 inches × ½ inch × 5/64 inch) was blasted with $Al_2O_3$ grit to a uniform rough surface and blown clean with air. A coating mixture was prepared by mixing 10.86 g "Cobalt Octoate" (12% Co) with 5.40 g Tantalum 2-ethyl Hexanoate (18.5% Ta).

The coating mixture was brushed onto the cleaned titanium plate. The plate was baked in a 400°C oven 15 minutes, removed, and cooled in air 10 minutes. Four more coats were applied in a similar manner, and a sixth coat was applied and baked 60 minutes at 400°C. The anode was placed in a type "A" test cell and operated continuously as described above. Initial voltage was 4.12 volts; voltage after 16 days continuous operation was 4.84V.

EXAMPLE XVI

An ASTM Grade 1 titanium plate approximately 6 inches × ½ inch × 5/64 inch was blasted with $Al_2O_3$ grit to a uniform rough surface and blown clean with air. A coating mixture was prepared by mixing 21.14 g "Cobalt Octoate" (12% Co) with 23.20 g Niobium 2-ethyl Hexanoate (4.13% Nb).

The coating mixture was brushed onto the cleaned titanium plate. The plate was baked in a 400°C oven 15 minutes, removed, and cooled in air 10 minutes. Four more coats were applied in a similar manner, and a sixth coat was applied and baked 60 minutes at 400°C. The anode was placed in a type "A" test cell and operated continuously as described above. Initial voltage was 4.16 volts; voltage after 2 days continuous operation was 4.82 volts.

EXAMPLE XVII

An ASTM Grade 1 titanium plate approximately 6 inches (15.24 cm) × ½ inch (12.7 mm) × 5/64 inch (1.98 mm) was blasted with $Al_2O_3$ grit to a uniform rough surface, blown clean with air, soaked briefly in dimethyl formamide, and allowed to air dry. A coating mixture was prepared by mixing 10.00 g "Cobalt Octoate" (12% Co) with 2.32 g Molybdenyl (V) Naphthenate (6.7% Mo).

The coating mixture was brushed onto the cleaned titanium plate. The plate was baked in a 400°C oven 15 minutes, removed, and cooled in air 10 minutes. This procedure was repeated for a second coat, and then a third coat was applied and baked for 60 minutes at 400°C. The anode was placed in a type "A" test cell and operated continuously as described above. Initial voltage was 3.41V; voltage after 4 days continuous operation was 3.43V.

EXAMPLE XVIII — COMPARATIVE EXAMPLE (ILLUSTRATIVE OF CONTEMPORARY COMMERCIAL PRACTICE)

A piece of material approximately 3 inches × 3 inches × 1¼ inches was cut from a commercial graphite anode. A hole was cut and threaded in the center of this piece and a threaded titanium rod inserted to provide electrical contact. The piece of graphite was placed in a type "B" test cell and operated continuously as described above. pH of the feed brine was controlled at 2.0 ± 0.5, well known as the optimum pH range for this type of graphite anode. Initial voltage was 3.089 volts; voltage after 125 days continuous operation was 3.630 volts. Considerable wear and loss of dimension of this graphite anode was evident.

Table III (For Examples XI–XVII)

| | Preparative Technique[1] | | | | | | Operating Data (0.5A/in²)[2] | | | |
|---|---|---|---|---|---|---|---|---|---|---|
| Example | Oxides in Coating | Approx. Mole Ratio Co/M | No. Coats | Baking Temp °C | Baking Time Min. | Baking Time of Final Coat, min. | Initial Voltage[3] | Final Voltage | Days Operation | Δv/t mv/day |
| XI | Co + Pb | 7.0 | 24 | 400 | 15 | 60 | 3.159 | 4.093 | 61 | 15.3 |
| XII | Co + V | 45.3 | 6 | 400 | 15 | 60 | 3.162 | 3.779 | 42 | 14.7 |
| XIII | Co + Zr | 11.0 | 24 | 400 | 15 | 60 | 3.186 | 3.250 | 12 | 5.3 |
| XIV | Co + Zr | 11.0 | 24 | 400 | 15 | 60 | 4.134 | 4.401 | 11 | 24.3 |
| XV | Co + Ta | 4.0 | 6 | 400 | 15 | 60 | 4.12 | 4.84 | 16 | 45.0 |
| XVI | Co + Nb | 4.0 | 6 | 400 | 15 | 60 | 4.16 | 4.82 | 2 | 330.0 |
| XVII | Co + Mo | 12.6 | 3 | 400 | 15 | 60 | 3.41 | 3.43 | 4 | 5.0 |

[1]Substrate was Ti plate except XIII which was Ti mesh and XIV which was Ta plate
[2]Cell "B" was used for XI through XIV; Cell "A" was used for XV through XVII
[3]After stabilization (usually 2–3 days)

We claim:

1. An electrode for use in an electrolytic process, said electrode comprising an electroconductive substrate having coated thereon an effective amount of a single-metal spinel structure of $Co_3O_4$.

2. The electrode of claim 1 wherein the electroconductive substrate is a film-forming metal.

3. the electrode of claim 2 wherein the film-forming metal is titanium, tantalum, zirconium, molybdenum, niobium, tungsten, hafnium, or vanadium.

4. The electrode of claim 3 wherein the film-forming metal is titanium, tantalum, or tungsten.

5. The electrode of claim 3 wherein the film-forming metal is titanium.

6. The electrode of claim 1 wherein the coating of single-metal spinel structure has a thickness in the range of about 0.01 mm to about 0.08 mm.

7. The electrode of claim 1 wherein the coating of single-metal spinel structure of $Co_3O_4$ contains a modifier oxide of metal.

8. The electrode of claim 7 wherein the modifier oxide is one or more oxides selected from the oxides of the metals in Groups III-A, IV-A, V-A, III-B, IV-B, V-B, VI-B, VII-B, the Lanthanide Group, and the Actinide Group of the Periodic Table of the Elements.

9. The electrode of claim 7 wherein the modifier oxide of metal is present in the film in an amount up to about 50 mole percent, based on the total amount of metal in said coating.

10. The electrode of claim 7 wherein the modifier oxide of metal is present in the amount of about 5 to about 20 mole percent, based on the total amount of metal in said film.

11. The electrode of claim 7 wherein the modifier oxide of metal is at least one oxide selected from the group consisting of oxides of titanium, tantalum, tungsten, lead, niobium, vanadium, zirconium, molybdenum, indium, chromium, tin, aluminum, antimony, cerium, and bismuth.

12. The electrode of claim 7 wherein the modifier oxide of metal is selected from the group consisting of the oxides of zirconium, vanadium, titanium, and molybdenum.

13. The electrode of claim 7 wherein the modifier oxide of metal is zirconium oxide or vanadium oxide.

14. An electrode for use in an electrolytic process, said electrode comprising:

a substrate of titanium having a coating, on the surfaces which are to be in contact with the electrolyte, of a single-metal spinel structure of $Co_3O_4$, said coating containing up to about 50 mole percent of a modifier oxide of zirconium oxide or vanadium oxide.

15. In an electrolytic cell comprising a housing, a cathode, an anode, and a diaphragm, said diaphragm being interposed between said cathode and anode, the improvement wherein the anode comprises a titanium substrate having a coating of $Co_3O_4$ containing up to about 50 mole percent of zirconium oxide or vanadium oxide.

16. A process for preparing an electrode comprising an electroconductive substrate having an electroconductive coating thereon, which process comprises, coating an electroconductive substrate with a thermally decomposable metal-organic compound which, when thermally decomposed yields an adhered film of a single-metal spinel structure of $Co_3O_4$, simultaneously coating the electroconductive substrate with a second thermally decomposable metal-organic, which, when thermally decomposed yields a modifier oxide of metal selected from Groups III-A, III-B, IV-A, IV-B, V-A, V-B, VI-B, VII-B, Lanthanides, or actinides of the Periodic Table of the Elements, said second metal-organic being present in an amount sufficient to provide up to about 50 mole percent of metal oxide, measured as metal, in the thermally decomposed coating;

and subjecting said coated electroconductive substrate to a temperature in the range of about 200° to about 600°C for a period of time sufficient to oxidize the metal-organic compounds to their corresponding oxide forms, thereby obtaining an electrode comprising an electroconductive substrate having a coating thereon of $Co_3O_4$ containing an evenly distributed modifier of metal oxide.

* * * * *

UNITED STATES PATENT AND TRADEMARK OFFICE

CERTIFICATE OF CORRECTION

PATENT NO. : 3,977,958

DATED : August 31, 1976

INVENTOR(S) : Donald L. Caldwell and Raymond J. Fuchs, Jr.

It is certified that error appears in the above-identified patent and that said Letters Patent are hereby corrected as shown below:

Col. 1, line 36, "electrochemicl" should be spelled as --electrochemical--.
Col. 4, line 51, "become" should be --becoming--.
Col. 5, line 33-34, "homogenously" should be spelled as --homogeneously--.
Col. 5, line 34, "through" should be --throughout--.
Col. 5, line 61, "0.77" should be --0.077--.
Col. 6, line 24, "0.77" should be --0.077--.
Col. 9, footnote 4 of Table I, "$CO_3O_4$" should be --$Co_3O_4$--.
Col. 10, line 19, "EXAMPLE VII", should be --EXAMPLE XII-- to conform to the same example tabulated in Table III.

Signed and Sealed this

First Day of March 1977

[SEAL]

*Attest:*

RUTH C. MASON
*Attesting Officer*

C. MARSHALL DANN
*Commissioner of Patents and Trademarks*